United States Patent [19]

White et al.

[11] Patent Number: 4,793,738

[45] Date of Patent: Dec. 27, 1988

[54] SINGLE LEG TENSION LEG PLATFORM

[75] Inventors: Charles N. White; Fikry R. Botros, both of Houston, Tex.

[73] Assignee: Conoco Inc., Ponca City, Okla.

[21] Appl. No.: 40,461

[22] Filed: Apr. 16, 1987

[51] Int. Cl.[4] ..... E02D 21/00; B63B 35/00

[52] U.S. Cl. ..... 405/224; 114/265; 405/195; 405/203

[58] Field of Search ..... 405/224, 202, 225, 203, 405/204, 195; 114/265, 264; 175/5, 7; 166/350, 359, 367

[56] References Cited

U.S. PATENT DOCUMENTS

| | | | |
|---|---|---|---|
| 3,285,213 | 11/1966 | Whittle | 114/205 X |
| 3,292,659 | 12/1966 | Haeber | 114/265 X |
| 3,389,671 | 6/1968 | Yost | 114/265 |
| 3,490,406 | 1/1970 | O'Reilly et al. | 114/265 |
| 3,643,446 | 2/1972 | Mott | 405/202 |
| 3,667,239 | 6/1972 | Mott | 405/202 |
| 4,152,088 | 5/1979 | Vilain | 405/202 X |
| 4,155,673 | 5/1979 | Yashima | 405/224 |
| 4,167,148 | 9/1979 | Fayren | 114/265 |
| 4,423,983 | 1/1984 | Dadiras et al. | 405/224 X |
| 4,585,373 | 4/1986 | Collipp | 405/224 |

*Primary Examiner*—Dennis L. Taylor

*Attorney, Agent, or Firm*—Richard K. Thomson

[57] ABSTRACT

A single leg tension leg platform is a semi-submersible structure moored at a deep water site by hybrid mooring consisting of a single tension leg or cluster of tendons attached to a central column and, optionally, a conventional spread mooring system. The central column is surrounded by peripheral stability buoyant columns symmetrically arranged and typically in number from about 3 to 8. All the vertical tendons are located in a tight cluster at the center of the platform. This means that the tendons no longer effectively restrain pitch/roll or yaw motion. The role of the tendon cluster is essentially the direct, stiff elastic restraint of heave and compliant restraint of horizontal offset. Pitch/roll response is controlled primarily by careful distribution of peripheral buoyancy and detuning.

17 Claims, 6 Drawing Sheets

FIG. 3
PRIOR ART
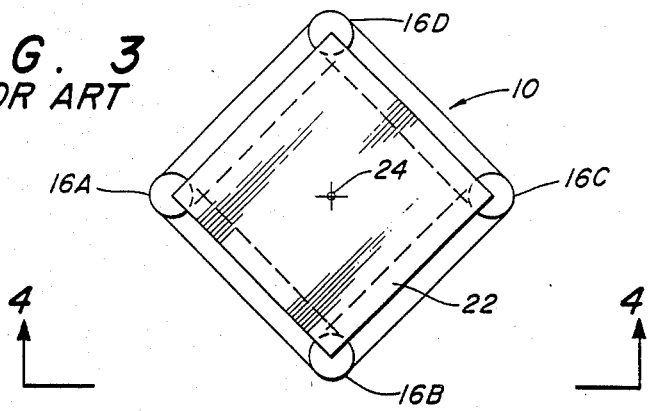
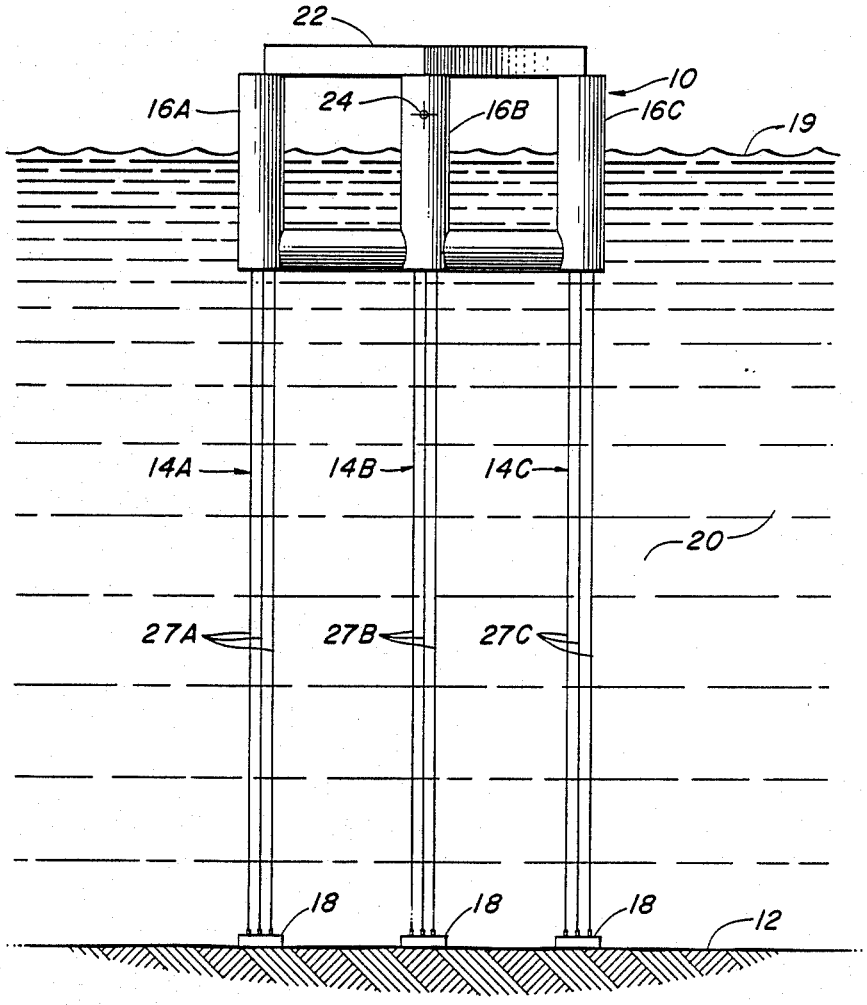
FIG. 4
PRIOR ART

SINGLE LEG TENSION LEG PLATFORM

This invention relates to the art of floating offshore structures and, more particularly, to a moored, floating platform for deep water offshore hydrocarbon production.

BACKGROUND OF THE INVENTION

With the gradual depletion of hydrocarbon reserves found onshore, there has been considerable attention attracted to the drilling and production of oil and gas wells located in water. In relatively shallow water, wells may be drilled in the ocean floor from bottom founded, fixed platforms. Because of the large size of structure required to support drilling and production facilities in deeper and deeper water, bottom founded structures are limited to water depths of less than about 1000–1200 feet. In deeper water, floating drilling and production systems have been used in order to reduce the size, weight and cost of deep water drilling and production structures. Ship-shape drill ships and semi-submersible buoyant platforms are commonly used for such floating facilities.

When a floating facility is chosen for deep water use, motions of the vessel must be considered and, if possible, constrained or compensated for in order to provide a stable structure from which to carry on drilling and production operations. Rotational vessel motions of pitch, roll and yaw involve various rotational movements of the vessel around a particular vessel axis passing through the center of gravity. Thus, yaw motions result from a rotation of the vessel around a vertically oriented axis passing through the center of gravity. In a similar manner, for ship-shape vessels, roll results from rotation of the vessel around the longitudinal (fore and aft) axis passing through the center of gravity causing a side to side roll of the vessel and pitch results from rotation of the vessel around a lateral (side to side) axis passing through the center of gravity causing the bow and stern to move alternately up and down. With a symmetrical or substantially symmetrical platform such as a common semi-submersible, the horizontally oriented pitch and roll axes are essentially arbitrary and, for the purposes of this disclosure, such rotations about horizontal axes wil be referred to as pitch/roll motions.

All of the above vessel motions are considered only relative to the center of gravity of the vessel itself. In addition, translational platform motions must be considered which result in displacement of the entire vessel relative to a fixed point, such as a subsea well head. These motions are heave, surge and sway. Heave motions involve vertical translation of the vessel up and down relative to the globally fixed point along a vertically oriented axis passing through the center of gravity. For ship-shape vessels, surge motions involve horizontal translation of the vessel along a fore and aft oriented axis passing through the center of gravity. In a similar manner, sway motions involve the lateral, horizontal translation of the vessel along a left to right axis passing through the center of gravity. As with the horizontal rotational platform motions discussed above, the horizontal translational motions, surge and sway, in a symmetrical or substantially symmetrical vessel such as semi-submersible are essentially arbitrary and, in the context of this specification, all horizontal translational vessel motions will be referred to as surge/sway motions.

Combinations of the above-described motions encompass platform behavior as a rigid body in six degrees of freedom. The six components of motion result as responses to continually varying harmonic wave forces. These wave forces are first said to vary at the dominant frequencies of the wave train. Vessel responses in the six modes of freedom at frequencies corresponding to the primary periods characterizing the wave trains are termed "first order" motions. In addition, a variable wave train generates forces on the vessel at frequencies resulting from sums and differences of the primary wave frequencies. These are secondary forces and corresponding vessel responses are called "second order" motions.

A completely rigid structure fixed to the sea floor is completely restrained against response to the wave forces. An elastic structure, that is, elastically attached to the sea floor, will exhibit degrees of response that very according to the stiffness of the structure itself, and according to the stiffness of its attachment to the firmament at the sea floor. A "compliant" offshore structure is usually referred to as a structure that has low stiffness relative to one or more of the response modes that can be excited by first or second order wave forces.

Floating production or drilling vessels have essentially unrestricted response to first order wave forces. However, to maintain a relatively steady proximity to a point on the sea floor, they are compliantly restrained against large horizontal excursions by a passive spread cantenary anchor mooring system or by an active controlled-thruster dynamic positioning system. These positioning systems can also be used to prevent large, low frequency (i.e. second order) yawing responses.

While both ship-shaped vessels and conventional semi-submersibles are allowed to freely respond to first order wave forces, they do exhibit very different response characteristics. The semi-submersible designer is able to achieve considerably reduced motion response by: (1) properly distributing buoyant hull volume between columns and deeply submerged pontoon structures, (2) optimally arranging and separating surface-piercing stability columns and (3) properly distributing platform mass. Proven principles for these design tasks allow the designer to achieve a high degree of wave force cancellation such that motions can be effectively reduced over selected frequency ranges.

The design practices for optimizing semi-submersible dynamic performance depend primarily on wave force cancellation to limit heave. Pitch/roll responses are kept to acceptable levels by providing large separation distances between the corner stability columns while maintaining relatively long natural periods for the pitch/roll modes. This practice keeps the pitch/roll modal frequencies well away from the frequencies of first order wave excitation and is, thus, referred to as "detuning".

Another class of compliant floating structure is moored by a vertical tension leg mooring system. The tension leg mooring also provides compliant restraint of the second order horizontal motions. In addition, such a structure stiffly restrains vertical first and second order responses, heave and pitch/roll. This form of mooring restraint would be essentially impossible to apply to a conventional ship-shape monohull due to the wave force distribution and resultant response characteristics. Therefore, this vertical tension leg mooring system is generally conceived to apply to semi-submersible hull forms which can mitigate total resultant wave forces and responses to levels that can be effectively and safely constrained by stiffly elastic tension legs.

This type of floating facility, which has gained considerable attention recently, is the so-called tension leg platform (TLP). The vertical tension legs are located at or within the corner columns of the semi-submersible platform structure. The tension legs are maintained in tension at all times by insuring that the buoyancy of the TLP exceeds its operating weight under all environmental conditions. When stiffly elastic continuous tension leg elements called tendons are attached between a rigid sea floor foundation and the corners of the floating hull, they effectively restrain vertical motions due to both heave and pitch/roll-inducing forces while there is compliant restraint of movements in the horizontal plane (surge/sway and yaw). Thus, a tension leg platform provides a very stable floating offshore structure for supporting equipment and carrying out functions related to oil production.

As water depth (and, thus tendon length) increases, tendons of a given material and cross-section become less stiff and less effective for restraining vertical motions. To maintain acceptable stiffness, the cross-sectional area must be increased in proportion to increasing water depth, thereby increasing the weight of the tendons and the size of the floating structure to maintain tension on the heavy tendons. For installations in deeper and deeper water, a tension leg platform must become larger and more complex in order to support a plurality of extremely long tension legs and/or the tension legs themselves must incorporate some type of buoyancy to reduce their weight relative to the floating structure. Such considerations add significantly to the cost of a deep water TLP installation.

In addition, in deeper and deeper water, a greater percentage of the hull displacement must be dedicated to excess buoyancy (i.e. tendon pretension) to restrict horizontal offset. Station-keeping is a key role for the mooring system. The vertical tension leg mooring system provides the capacity to hold position above a fixed point on the sea floor as any horizontal offset of the platform creates a horizontal restoring force component in the angular deflection of the tendon tension vector. In deeper and deeper water, it requires greater tendon pretension to provide enough restoring force to keep the TLP within acceptable offset limits. This increase leads to larger and larger minimum hull displacements. The use of a hybrid mooring system as described for this invention reduces the impact of increasing water depth on minimum hull displacement and tendon pretension.

SUMMARY OF THE INVENTION

The present invention provides a deep water drilling and production facility of relatively low complexity which combines the advantages of a catenary moored semi-submersible with some of the advantages of a tension leg platform at greatly reduced cost.

In accordance with the invention, a single leg tension leg platform (STLP) comprises a large central buoyant column surrounded by a number of peripheral stability columns. In a preferred embodiment, peripheral stability columns are symmetrically spaced about the central column. The central column and peripheral stability columns are connected together as one structure. This connection can take the form of an arrangement of subsea pontoons which connect the various columns near their lower ends and/or, key structural bracing above the water surface. The columns, especially the central column, support the deck from which drilling and other operations can be conducted.

Further in accordance with the invention, the above STLP has a mooring system which incorporates both a vertical single tension leg system and a spread catenary mooring system. The vertical tension leg is arranged so that it effectively only restrains the heave component of vertical motions. However, the vertical tension leg mooring system and the spread mooring act in concert to compliantly restrain low frequency horizontal motions, surge/sway and yaw.

In accordance with the preferred form of the invention, there is one and only one tension leg in the STLP and it connects the central column with anchors on the sea floor. The peripheral stability columns have no tension legs. The single tension leg is made up of one or more tendons which may be steel pipe, composite tubular, metallic cable or synthetic fiber cable or combinations of these materials.

Locating the tendons in a tight cluster only at the center of the platform structure means that the tendons no longer (as occurs in conventional tension leg platforms) effectively restrain pitch/roll or yaw motions. The role of these tendons is reduced to the stiff restraint of heave and compliant restraint of horizontal offset. Pitch/roll responses are controlled primarily by careful distribution of peripheral buoyancy and detuning design in accordance with known semi-submersible design practices. As will be explained, an important feature of this invention is that the central tendons restrain heave only and the pitch/roll response is detuned.

It is therefore an object of this invention to obtain a single leg tension leg platform in which a single, essentially vertical, tension leg connects between the central buoyant column of the structure and anchors on the sea floor so that the tendons of this one leg stiffly restrain only the heave component of vertical motions. Horizontal motions are compliantly restrained by this vertical tension leg in concert with the catenary mooring system.

It is a further object of this invention to adjust the quantity, size, and position of the peripheral stability columns and pontoons with respect to the position of the central column so that the pitch/roll response of the structure is minimized.

BRIEF DESCRIPTION OF THE DRAWINGS

These and other objects of the invention will be readily apparent from the following description taken in conjunction with the drawings forming a part of this specification and in which:

FIG. 3 is a simplified view of a typical tension leg platform of the prior art.

FIG. 4 is a view taken along the line 4—4 of FIG. 3.

DETAILED DESCRIPTION OF THE INVENTION

Figure 5:
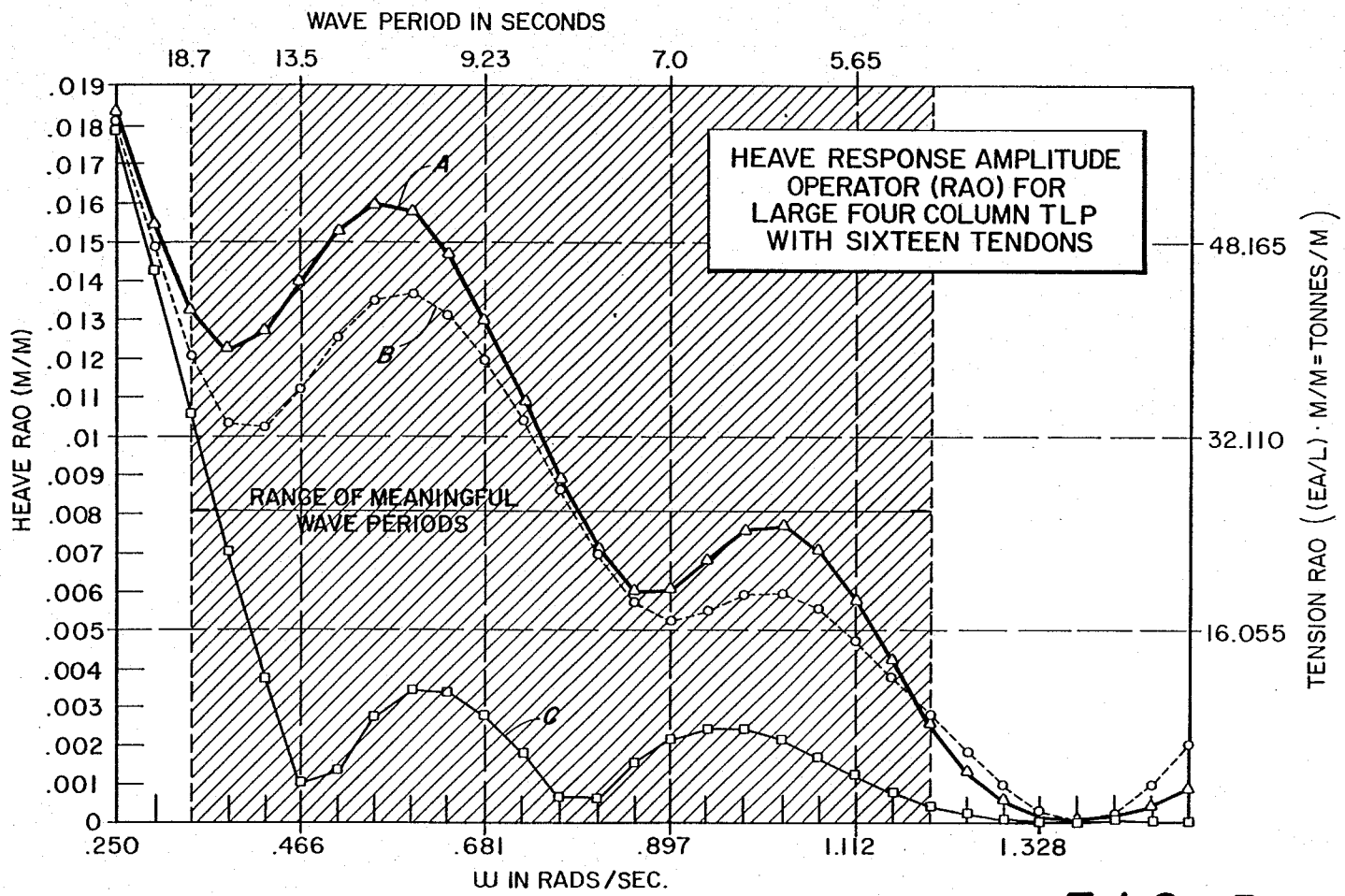
FIG. 5 are curves showing heave response amplitude operator (RAO) at various points on a tension leg platform.

In order to fully understand the curves of FIG. 5 and to explain the improvements and differences of the present invention of the single leg tension leg platform (STLP) compared with the conventional tension leg platform (TLP) concepts, it is believed that a typical TLP should be generally described. A simplified TLP shown in FIGS. 3 and 4 is typical of the prior art TLP. Shown thereon is a tension leg platform 10 floating on a body of water 20 having a marine bottom 12 and a surface 19. A pluarlity of tension legs 14A, 14B and 14C connects buoyant columns 16A, 16B and 16C to anchors 18 at the floor of the body of water 10. A deck 22 is supported by columns 16A–16D as shown in FIG. 3. The center of gravity is indicated by numeral 24 in FIGS. 3 & 4.

In a conventional TLP, the tension legs 14A–D comprise a plurality of tendons 27 A–D connecting their respective columns 16A–D and bottom anchors 18. The tendons 27 A–D must resist the variations in forces which are mainly those caused by waves exciting the tendency of the platform to heave, pitch/roll, surge/sway and yaw. These terms are used herein as explained previously. Pitch/roll motions have a very pronounced effect on inducing tension variations in the tendons 27 which connect the TLP to its anchors 18. Therefore, in a tension leg platform, resultant motions at the platform corners due to heave and pitch/roll are the main factors which induce tension variation in the tendons. Most importantly, fatigue problems occur in the tendons of the tension legs of TLP's when the pitch/roll period exceeds 4 seconds.

The tendon groups (tension legs 14) for each of the corner columns 16 of a TLP must counteract great dynamic forces and therefore must be very strong. They are also generally designed to be adequately stiff (elastically) to insure the pitch/roll and heave natural periods of the moored platforms are below the range of important wave exciting periods (i.e., generally 4–10 seconds). For most TLP designs, it is pitch/roll response that is of most concern for wave excitation around 6 seconds. In very deep water it becomes more and more costly to make tendons which are stiff enough to keep the natural response period for pitch/roll below the "4 second limit".

Figure 1:
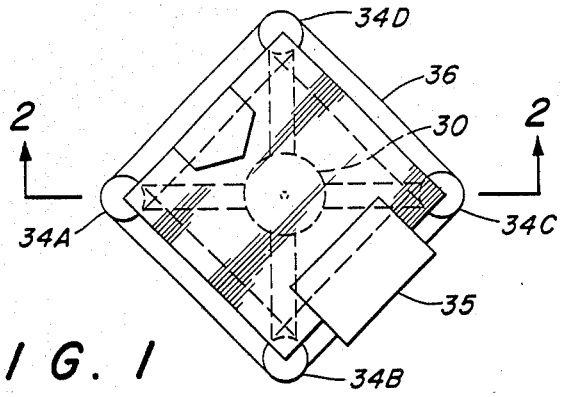
FIG. 1 is a simplified top view of the single leg tension leg platform (STLP) concept of this invention.
Figure 2:
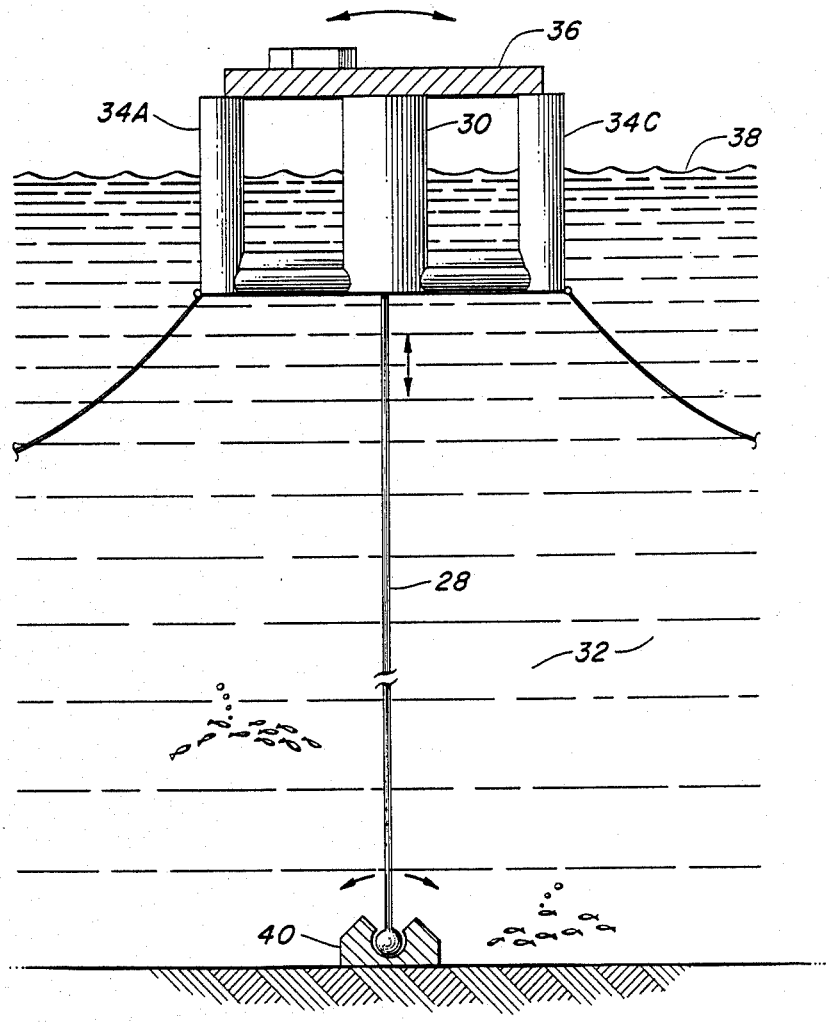
FIG. 2 is a view along line 2—2 of FIG. 1.
Figure 6:
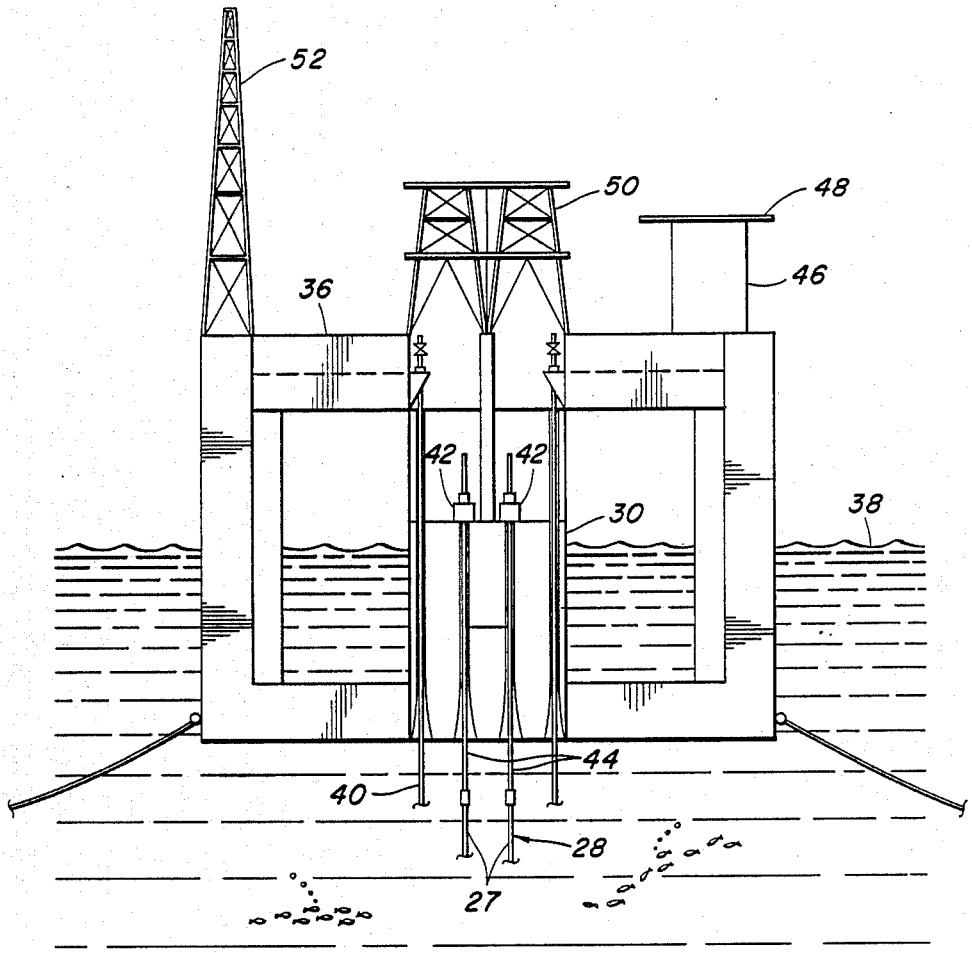
FIG. 6 is a view showing the basic STLP configuration showing the peripheral stability columns, risers and processing area for an STLP.

Attention is next directed to FIGS. 1 and 2 which show in simplified form the single leg tension-leg platform (STLP) of this invention. This is a semi-submersible structure moored or anchored in deep water 32 by a single tendon 28 or cluster of tendons (FIG. 6 shows a cluster of tendons 27) attached to a central buoyant column 30 of the STLP. The tendon or tendon cluster 28 is connected at the upper end to the center of the main structure and can be connected to an anchor 40 in the ocean floor using commercially available flex or taper joints. Flex joints may also be positioned at the top of the tendons to allow rotation. These connections at the top and bottom can be quite similar to those used in conventional TLP concepts.

The STLP can have outrigged modules such as peripheral stability columns 34A, 34B, 34C and 34D. There are no vertical mooring tendons extending from any of the stability columns. Central column 30 and peripheral columns 34A, 34B, 34C and 34D support a deck 36 above the surface 38 of the body of water. The deck may have typical deck structures such as quarters 35 and a well bay. The central column 30 directly supports the tendon loads, part of the deck weight and (optionally) the riser loads. This yields a lightweight deck structure increasing the useful payload for a given displacement (as compared to supporting the deck only at its corners). There is an optional number (at least three(3)) of peripheral stability columns surrounding the central column. These peripheral columns 34 should also be symmetrically located about the central column 30.

The main thrust of the STLP concept is to simplify tension leg platform design by minimizing the role of the vertical tension leg mooring system and reducing the structural loads on the tendons themselves. In accordance with this invention, the tendons of the single tension leg no longer effectively restrain pitch/roll motion. The structure is designed to effectively remove most of the effect of pitch/roll on the tendon cluster 28. With this concept, the tendon cluster 28 resists heave but even here the forces associated only with heave are reduced. As shown in FIG. 2, the only vertical tendons are in the central, single tension leg and are either a single tendon or a tight cluster around the Center of Gravity of the platform which in this case is the center of main column 30. When placed in this position, the tendons no longer effectively restrain pitch/roll or yaw motions as is required of tension legs in the prior art tension leg platform such as shown in FIGS. 3 and 4. The role of the tendon cluster 28 in this invention is reduced to the essentially direct, stiff elastic restraint of heave and compliant restraint of horizontal offset.

The dramatic reduction in tendon load variations achieved by using this concept is demonstrated in FIG. 5 which shows curves calculated using accepted calculating procedures. The calculations and following discussions relate to a structure located vertically over a bottom foundation and the linear theory of response calculation. Shown on the ordinate is the heave response amplitude operator (RAO) in (M/M) which is meters of heave that the platform will move per meter of ocean wave height. The righthand side of the chart shows the tension RAO in units of tonnes/meter. The tension variation RAO is obtained by multiplying heave of the tendon's top end by the axial stiffness (EA/L) of the tendon. The ocean wave period in seconds and frequency in radians/second is shown as the abscissa. The range of the meaningful ocean wave period of importance is from about 18 seconds down to about 4 seconds. Curves A and B of FIG. 5 indicate the resultant heave at a corner column of a conventional TLP such as columns 16A or 16C shown in FIG. 4 when waves are traveling along the diagonal axis of the platform. This heave includes the transformed component of pitch/roll motion.

According to the concept of the STLP, there is an attachment of a tension leg or tendon cluster only at the center of the platform. There is no other vertical tension element and the structure is detuned so there is essentially no effect of pitch/roll on the central tension leg. Therefore, there are essentially only pure heave forces on this single tension leg and essentially no pitch/roll effect thereon or at least the effect will be so small as to be possible to ignore it. Curve C (FIG. 5) represents direct pure heave of the TLP at its center of gravity. A tension leg or tendon cluster attached at the center of gravity would experience stretching forces due only to the direct heave of the platform. It is readily observed from curve C compared to curves A and B that a tension leg or tendon cluster connected at or near the center of gravity (CG) as taught herein will experience only a fraction of the tension load variations as that of a corner tension leg or tendon cluster over the full range of the important wave lengths.

Another advantage of deep water platform design based on STLP design principles is that the use of a hybrid (tension leg plus spread) mooring system allows reduction in platform displacement while maintaining the same or better station-keeping properties as the prior art TLP's. This reduction in size (and, thus, cost) results by taking advantage of the fact that a properly designed spread mooring can be more efficient than a vertical tension leg mooring in providing lateral restoring force for station-keeping. The use of a spread mooring system to assist the tension leg mooring system in restricting horizontal offsets allows the total amount of pretension in the tension-leg system to be reduced. This results in a significant decrease of required platform displacement and, thus, cost. Since providing a permanent spread mooring system adds little cost to the temporary mooring system which is usually required for installing a deep water tension leg moored platform, the overall cost for a STLP (including mooring systems) is less than a comparable TLP of the prior art.

In accordance with this invention, there is only the single tendon or cluster of tendons in the center of the structure which effectively restrains only heave. The pitch/roll response is detuned. This is a unique combination. In order to keep the pitch/roll from being much of a factor on the single tension leg of the platform, the floating structure of this invention is detuned; that is, it is designed to keep the natural pitch/roll period of the structure outside the range of the ocean wave periods which are typically in the range of 4 seconds to 18 seconds. If the natural period of the pitch/roll response structure is above 30 seconds, the structure is in a very good state. In any event, the natural roll/pitch period should be well above about 20 seconds which is normally above the ocean wave period of interest. It is, or course, known that some periods caused by swell may be higher than 20 seconds but these ordinarily are of relatively low wave height.

The STLP is detuned using semi-submersible design theory. As used herein, detuning in relation to pitch-/roll response means to design the pitch/roll response period outside of the ocean wave of interest, which, as just stated is from about 4 seconds to about 18 seconds. Generally speaking, the natural period of the pitch/roll response can be made longer by moving the peripheral columns inwardly and/or reducing the total water plane through the columns which is the cross-sectional area thereof.

Attention is next directed to FIG. 6 which illustrates one arrangement of tendons 27 and risers 40 within the central column 30. The tendons are connected to connectors 42 which are fixed to and supported from the central column 30 so that load on the tendons 27 is carried directly by the central column 30. Flex joints 44 are provided as near the water surface 38 as possible. This helps to restrict the mean trim/heel angle due primarily to wind loads during extreme environmental conditions. The risers 40 extend above the water surface 38 and can be attached by conventional connector controls. Since the risers 40 located within the central column 30 are protected from wave forces, it may also be possible to provide simple elastic top end support connections. Living quarters 46 supporting heliport 48, workover derrick 50, flare 52 and other utilities are supported from the deck 36.

As previously discussed, the pitch/roll period of the STLP of this invention is not constrained to be less than 4 seconds as generally required in TLP's. In addition, the heave natural period is not restricted to be less than 4 seconds, but may be allowed to approach 6 seconds or more and gives several benefits. For example, more elastic (softer) tendons may be used. For solid steel cross sections this means less steel may be required. More importantly, this fact should, in many cases, allow the use of parellel strand or even relatively highly pitched steel cables, or synthetic fiber cables (KEVLAR® aramid fiber, carbon fiber and etc.). Any of the latter may be spooled on relatively small diameter drums which will allow quick installation of the tension leg directly from the STLP on arrival at the field.

Figure 9:
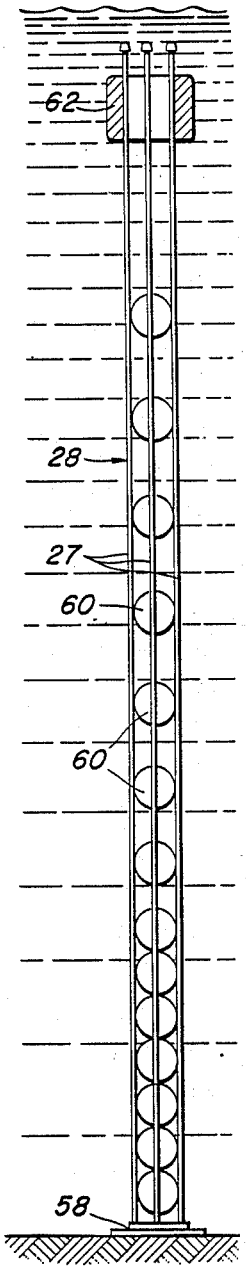
FIG. 9 illustrates a six-tendon bundle having permanent buoyancy and installed at a foundation template prior to the STLP arrival.

Attention is next directed to FIG. 9 which shows a tendon cluster 28 which is composed of 6 individual tendons 27. This free standing tendon cluster can be installed at the foundation 58 prior to arrival of the platform. If these tendons 28 are made of steel, then there should be permanent buoyant means 60 permanently attached thereto. This buoyancy may be obtained by adding syntactic foam. The buoyancy should preferably be equal to about half that of the weight of the steel. There is also shown a temporary buoyancy module 62 at the top of the tendon cluster 28. The tendons of FIG. 9 can be connected between the STLP central column and the sea floor anchor similar to the method of connecting tendons between the legs of a TLP and the sea floor.

Figure 8:
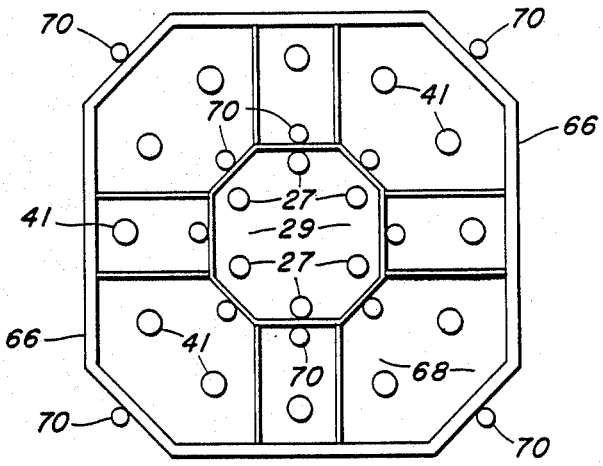
FIG. 8 illustrates a sea floor template for use with this STLP.

Attention is next directed to FIG. 8 which shows a sea floor template 65 which includes an outer frame 66 with riser pipes 41 extending through holes in the plate 68 of the template 65. There are also provided a plurality of anchoring piles 70 which anchor the template 65 in a known manner. The six tendons 27 are each secured to plate 29 by commercially available flex joint anchor connectors. These connections of tendons, risers and anchors to the template can be done using known techniques and commercially available equipment. Being able to install this relatively small, integrated well/foundation template in one operation offers a distinct advantage over multiple, complex operations planned and performed for the prior art TLP's.

Figure 7A:
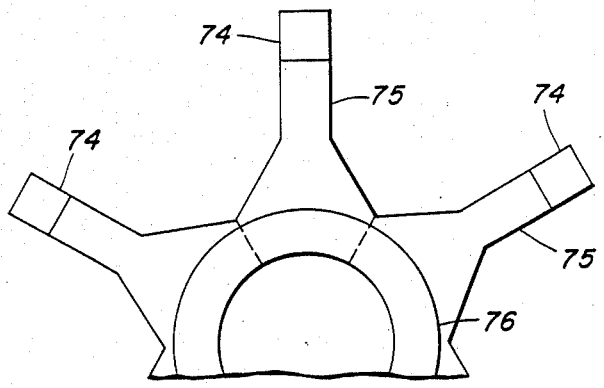
FIGS. 7A and 7B show a simplified top and side view, respectively, or a pontoon arrangement for the STLP of this invention.
Figure 7B:
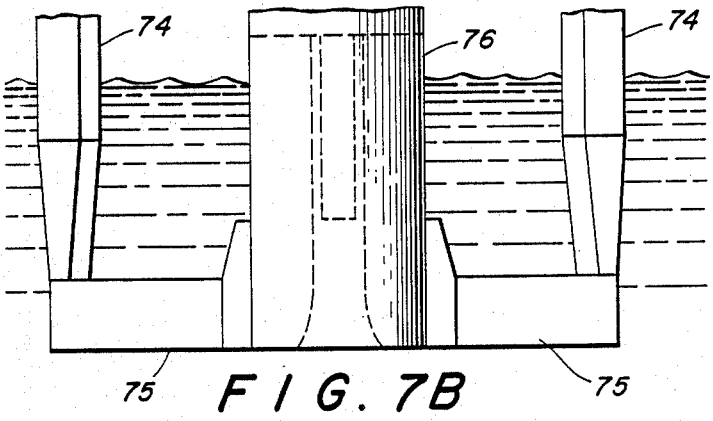

FIGS. 7A and 7B show pontoon arrangements for using 5 peripheral columns 74 connected to a central column 76 by pontoons 75.

Figure 10:
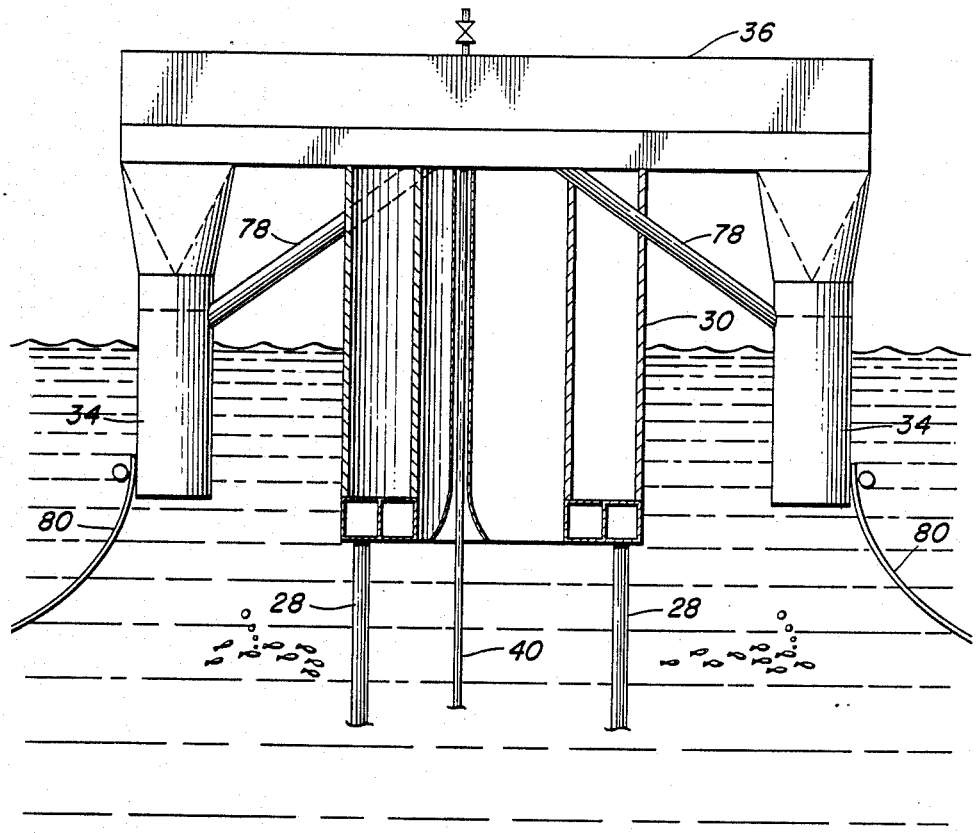
FIG. 10 shows a side view of the main column and peripheral columns of this invention's single leg tensioned platform with lightweight yaw control mooring attached to the peripheral columns.

Attention is next directed to FIG. 10 which shows peripheral columns which are not connected by pontoons but by structural bracings. Shown thereon is a main column 30 supporting a main deck 36. Braces 78 are used to help secure the peripheral columns 34 to the deck 36. Lightweight spread mooring line 80 is included to restrict the yaw. Note the tendons have been moved to outside of the center column but still act as a single tension leg with only limited Pitch/Roll restraint. Mooring line 80 will have no effect on central heave.

While the invention has been described in the more limited aspects of preferred embodiments thereof, other embodiments have been suggested and still others will occur to those skilled in the art upon a reading and understanding of the foregoing specification. It is intended that all such embodiments be included within the scope of this invention as limited only by the appended claims.

Having thus described our invention, we claim:

1. A single leg tension leg platform for use in a body of water having a bottom and a surface comprising:
   a deck;
   a central buoyant column;
   at least three peripheral buoyant columns symmetrically located about said central buoyant column;
   connection means for connecting said peripheral buoyant columns and said central buoyant column;
   supporting means for supporting said deck from said central buoyant column and said peripheral buoyant column;
   one and only one vertical tension leg having a top and a bottom with the top connected to said central buoyant column and a bottom connectable to an anchor on said bottom; whereby said central column and said peripheral columns have sufficient positive buoyancy to support said deck above said water surface and to maintain said tension leg in tension.

2. A single leg tension leg platform as defined in claim 1 in which the natural period of the pitch/roll response of the platform is greater than about 20 seconds.

3. A single leg tension leg platform as defined in claim 1 in which said connecting means includes pontoons connecting a lower end of the peripheral buoyant columns with said central buoyant column.

4. A single leg tension leg platform as defined in claim 1 in which said connecting means includes structural bracing members above said water.

5. A single leg tension leg platform as defined in claim 1 including catenary mooring for restricting horizontal motions of the platform and connected only between the peripheral columns and said bottom at a distance horizontally spaced therefrom.

6. A single leg tension leg platform as defined in claim 1 wherein said tension leg comprises a tendon bundle including a plurality of tendons.

7. A single leg tension leg platform as defined in claim 6 wherein said tendon bundle is preinstalled and attached to said anchor.

8. A single leg tension leg platform for use in a body of water having a bottom and a surface comprising :
   a main structure including a deck;
   an anchor positioned on the bottom of said body of water;
   a single, essentially vertical, tension leg connected to an interior central area of said structure and to said anchor, said single tension leg being the only essentially vertical mooring connection between the structure and said water bottom, said tension leg being maintained in tension between said structure and said water bottom;
   buoyancy means including peripheral stability buoyant support columns for supporting said main structure.

9. A single leg tension leg platform as defined in claim 8 in which a roll/pitch response period of the platform including the deck and buoyancy means is greater than 20 seconds.

10. A single leg tension leg platform as defined in claim 8 in which said tension leg comprises a tendon bundle including a plurality of tendons.

11. A single leg tension leg platform as defined in claim 8 further including a plurality of risers extending from subsea wells to said platform, said risers being disposed in a concentric array relative to said tension leg.

12. A single leg tension leg platform as defined in claim 8 in which said tension leg comprises a plurality of synthetic fiber cables that may be spooled on relatively small diameter drums.

13. A single leg tension leg platform as defined in claim 8 in which said tension leg comprises a plurality of steel cables that may be spooled on relatively small diameter drums.

14. A single leg tension leg platform as defined in claim 8 including catenary mooring for restricting yaw motions of the platform and connected only between the peripheral columns and said bottom at a distance horizontally spaced therefrom.

15. A single leg tension leg platform for use in a body of water having a bottom and a surface comprising:
   a deck;
   a central buoyant column for supporting said deck;
   outrigged modules;
   connecting means for rigidly interconnecting said modules and said central buoyant column;
   an anchor at said bottom;
   one and only one vertical tension leg having a top and a bottom end;
   means to connect the top end of said tension leg to said central buoyant column and the bottom end to said anchor, means to maintain said vertical tension leg in tension between said central buoyant column and said anchor, there being no essentially vertical anchoring member between said outrigged modules and said bottom.

16. A single leg tension leg platform as defined in claim 15 including a catenary mooring for restricting horizontal motions connected between said modules and said bottom at a distance spaced horizontally therefrom;
   whereby said platform is allowed to pitch/roll but is restrained against heave motion by the single essentially vertical tension leg.

17. A single leg tension leg platform as defined in claim 15 in which said outrigged modules are connected to said center column by submerged pontoon structures and by bracing above said surface of the water with the pontoons and buoyancy modules structured to minimize wave induced responses of pitch and roll.

* * * * *